US005915903A

United States Patent [19]

Osterle et al.

[11] Patent Number: 5,915,903

[45] Date of Patent: Jun. 29, 1999

[54] LARGE-AREA WASHER HAVING FRICTION INCREASING ELEMENTS ON THE UNDERSIDE THEREOF

[75] Inventors: Helmut Osterle, Feldkirch, Austria; Stefan Baumgartner, Altstatten; Marcus Steffen, Grabs, both of Switzerland

[73] Assignee: SFS Industrie Holding AG, Heerbrugg, Switzerland

[21] Appl. No.: 08/656,250

[22] PCT Filed: Dec. 5, 1994

[86] PCT No.: PCT/EP94/04037

§ 371 Date: Jul. 26, 1996

§ 102(e) Date: Jul. 26, 1996

[87] PCT Pub. No.: WO95/16087

PCT Pub. Date: Jun. 15, 1996

[30] Foreign Application Priority Data

Dec. 10, 1993 [DE] Germany ..... 43 42 263

[51] Int. Cl.[6] ..... F16B 43/00

[52] U.S. Cl. ..... 411/531; 411/160; 52/512

[58] Field of Search ..... 411/160, 531, 411/533, 466, 467; 52/410, 512

[56] References Cited

U.S. PATENT DOCUMENTS

| | | | |
|---|---|---|---|
| 3,588,787 | 6/1971 | Kindell | 411/531 |
| 4,627,207 | 12/1986 | Young et al. . | |
| 4,726,164 | 2/1988 | Reinwall et al. . | |
| 4,787,188 | 11/1988 | Murphy | 411/531 |
| 5,069,589 | 12/1991 | Lemke | 411/160 |
| 5,096,350 | 3/1992 | Peterson | 411/160 |
| 5,323,984 | 6/1994 | Lackowski | 411/531 |

FOREIGN PATENT DOCUMENTS

| | | |
|---|---|---|
| 91 04865 | 10/1992 | France . |
| 2 086 517 | 5/1982 | United Kingdom . |

*Primary Examiner*—Flemming Saether
*Attorney, Agent, or Firm*—Helfgott & Karas, PC.

[57] ABSTRACT

In a large-area washer (1) there is an aperture for the insertion of a fastener and a bead (16) to stiffen the washer (1). To provide better engagement with a plate and/or web to be fastened, there are engagement components (13) on the underside of the washer (1) which are pressed out of the whole material of the washer (1) and project approximately perpendicularly downwards from it. The engagement components (13) are conical or truncated cones.

6 Claims, 2 Drawing Sheets

LARGE-AREA WASHER HAVING FRICTION INCREASING ELEMENTS ON THE UNDERSIDE THEREOF

BACKGROUND OF THE INVENTION

The invention relates to a large-area washer with an opening for inserting a fastener, which has protruding meshing elements at the surface pointing in the fastening direction, which elements increase the friction or meshing with a panel and/or sheet to be fastened.

Such a washer, which is known from the European patent application EP 02 83 184 A1 has, on its underside, as meshing elements, molded pins that are conically pointed. In another known large-area washer, meshing elements are provided that are embodied as conical points, which are also produced in conjunction with the manufacture of the washer (U.S. Pat. No. 4,987,714). In both cases, relatively thick plastic washers are at issue. The provision of other forms of meshing elements on the underside of such plastic washers which, however, may be produced only by an injection-molding process, is also known (U.S. Pat. No. 5,069,589).

In the case of one known large-area metal washer, such meshing elements are formed of brackets stamped out of the whole material of the washer and pressed downward, such that these brackets, in frontal view, are embodied in each case, in triangular shape and are oriented with a downward point (U.S. Pat. No. 4,763,456). The triangular brackets do grip relatively well into insulation or roofing sheets, which are to be fastened. However, a serious disadvantage is presented by the fact that the brackets, which are bent downward, constitute knife blades of a sort when the corresponding forces act upon the roofing sheet, thus destroying the roofing sheet. As soon as no more than a very small cut is produced in the roofing sheet, no great tensile forces are required any longer to pull the roofing sheet out from under the washer. Such tensile forces on the roofing sheet often result from the effects of the wind, particularly in the case of flat roofs.

Washers having a large area are usually used on a solid underlying structure to fasten single layer or multi-layered roofing sheets and/or an insulation layer. The forces arising between the roofing sheet and the underside of the washers are relatively high and result, in particular, when the danger exists that the roofing sheet underneath the fastener or under the washer will be pulled out due to corresponding suction stresses. This tensile stress on the roofing sheet occurs transverse to the axis of the screw, that is, parallel to the plane of the large-area washer. The retentive force of downward bent, blade-like brackets is too slight, so that the roofing sheet, which is, in each case, attached in the area of the edge, is torn out underneath the washer.

A large-area washer, which is intended to extend beyond the contacting edges of two sealing coating sheets is already known (DE-A-29 30 993). The two end regions of this washer have, in each case, a through hole, at the edges of which gripping teeth that constitute gripping organs are embodied. In this instance, relatively large holes are stamped out, such that the edge areas of these holes are bent downward as individual pointed brackets.

Such an embodiment would also not lend itself well to absorbing correspondingly large suction forces acting on the roofing sheet, due to the fact that the gripping teeth grip into the roofing sheet with an insufficient degree of strength or, if they do engage properly, function once again as blades, which cause a separation of the sheet in response to tensions parallel to the plane of the washer.

SUMMARY OF THE INVENTION

It is therefore an object of the present invention to create a large-area washer of the type mentioned at the outset, which provides an optimal holding of the panel and/or sheet to be attached, without the risk that the panel or sheet will be cut by an appropriate force.

Pursuant to the invention, this objective is accomplished owing to the fact that several pointed meshing elements, pressed from the full material of the washer and oriented at least approximately perpendicularly to the plane of the washer, are provided, which are connected at least across a partial area of their length as circumferentially closed conical bodies, truncated conical bodies, pyramidal, truncated pyramidal, cylindrical, or prismatic bodies.

By these means, as is otherwise customary only in the case of plastic washers, downward oriented, pointed meshing elements are created, which bring about a good meshing with the roofing sheet or a panel that is to be secured, yet prevent or do not promote, a cutting up of the roofing sheet. Due to the inventive measure, the possibility exists that the washer, with its meshing elements, can mesh with a roofing sheet, without cutting any fiber reinforcement that may be present in the roofing sheet.

The meshing elements, of particular construction, pressed from the full material of the washer, do not result in cutting edges of any kind, which could damage a sheet.

A potential, particular embodiment resides in the fact that the meshing elements are constructed in the form of cup-like depressions pressed from the full material of the washer. Through deformation with an appropriate counteracting tool, by deep drawing at the desired sites of the large-area washers, an appropriate number of meshing elements can be produced, while the formation of cutting edges is entirely precluded as a result of the circumferentially closed conical, truncated conical, pyramidal, truncated pyramidal, cylindrical, or prismatic form. Thus, even when large-area metal washers are used, it is possible to create, in a particular manner, an effective meshing element, without the danger of cutting the roofing sheet under load.

It is entirely possible that the free ends of the meshing elements, that is, the areas of their points break up slightly, even as the meshing elements are manufactured. However, such a construction can be brought about deliberately, if the meshing elements have, at their free end, an axial diameter, which is relatively small in relation to the diameter at their foot. By these means, a corresponding roughening or a sharp-edged region, which increases the friction relative to the panel and/or the sheet that is to be fastened, and also, an improved meshing with the panel or the sheet results particularly in the region of the meshing elements. Nevertheless, an effective cutting edge parallel to the plane of the washer is not created.

In the case of a different embodiment, it is proposed that the wall thickness of the meshing element decrease constantly from the foot to the freely protruding end. Such a variation exists particularly when the solid material is pressed through with an appropriate counter mold and a pressing die. This has an additional positive side effect in that the meshing elements become somewhat more elastic in the direction of their free end and, as a result can absorb large forces more easily.

In this regard, it is advantageous if, in the case of a conical meshing element, the outer conical angle is 50° to 90° and preferably 65° to 80° and the inner conical angle is 30° to 50° and preferably 35° to 45°. Precisely this particular magnitude of the conical angle brings about an optimal meshing with the roofing sheet or panel to be secured, such that a cutting effect nevertheless being precluded. Similar angles can also be provided for a pyramidal meshing element.

BRIEF DESCRIPTION OF THE DRAWINGS

Examples of the invention are explained in greater detail in the following by means of the drawings, in which.

DESCRIPTION OF PREFERRED EMBODIMENTS

Figure 1:
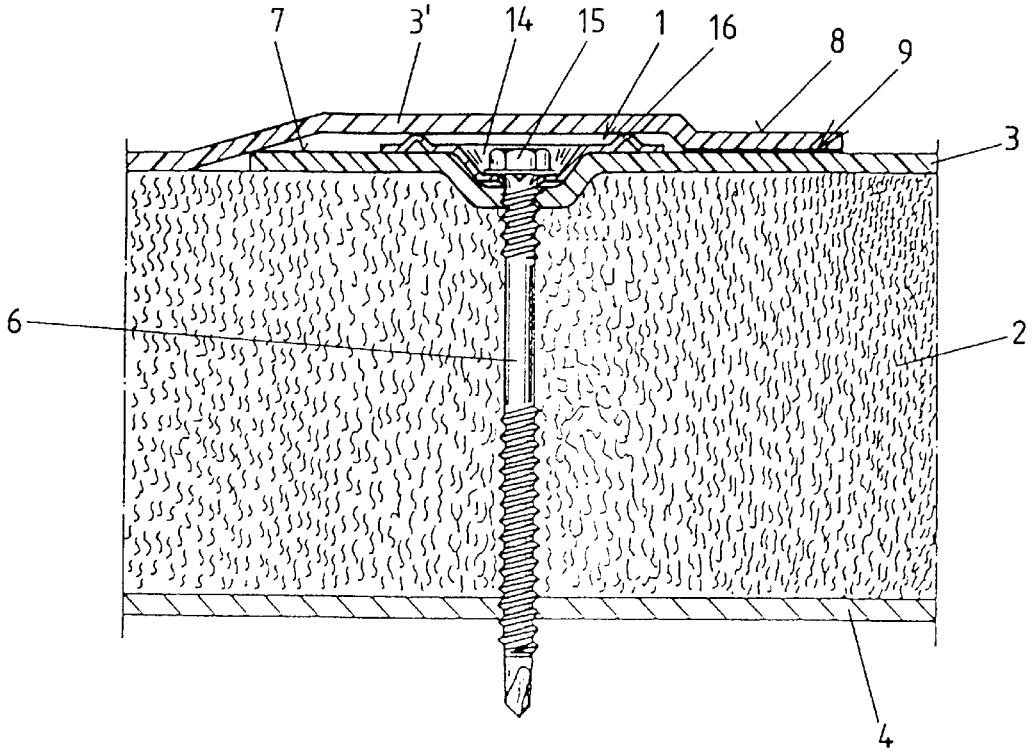
FIG. 1 shows a section though an example of a large-area washer in conjunction with fastening layers of insulation and roofing sheet.

A large-area washer 1 is used to fasten an insulation layer 2 and a roofing sheet 3, covering this, on a solid substructure 4. A fastener 6, which in this case is constructed as a screw, is introduced into the opening 5. The roofing sheet 3 is fastened at the edge region 7, the edge region 8 of the subsequent roofing sheet 3' covering the screwing sites. The roofing sheets 3 and 3' are then glued or welded together in the region 9. The fastening itself, is thus placed in a region, which is sealed off from the outside.

Figure 2:
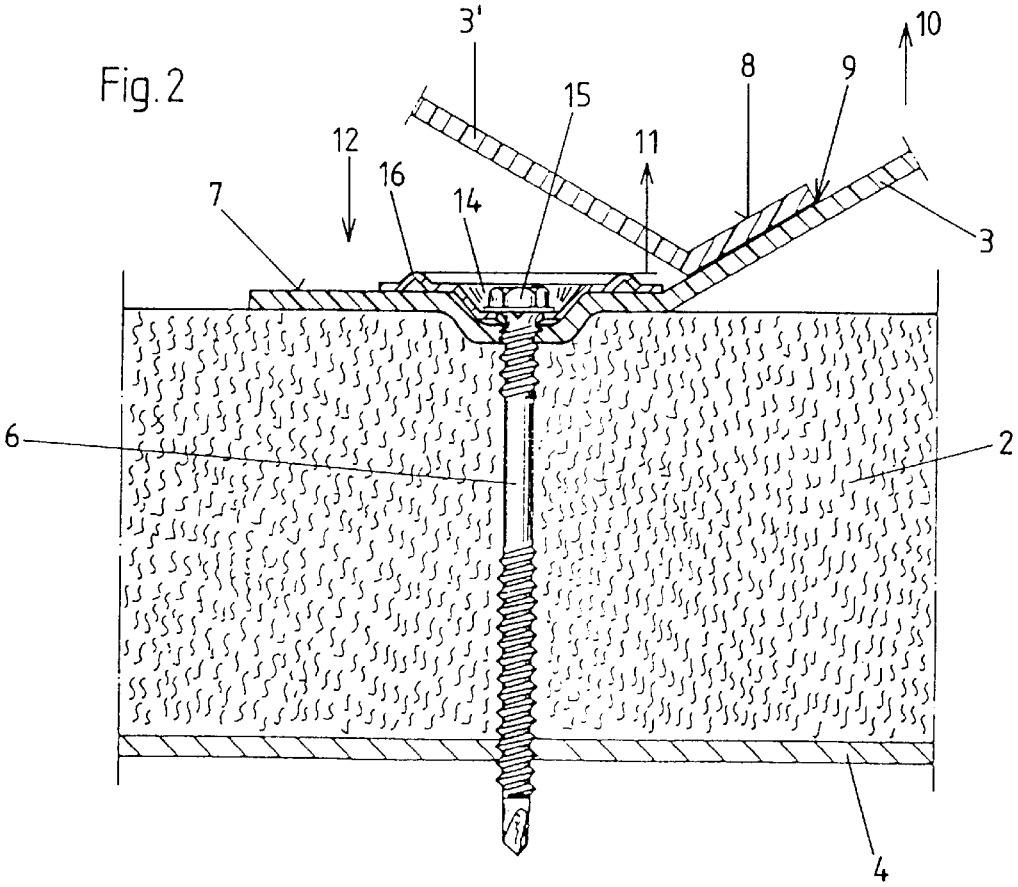
FIG. 2 shows the same example as FIG. 1; however, corresponding forces are acting on the roofing sheet.
Figure 4:
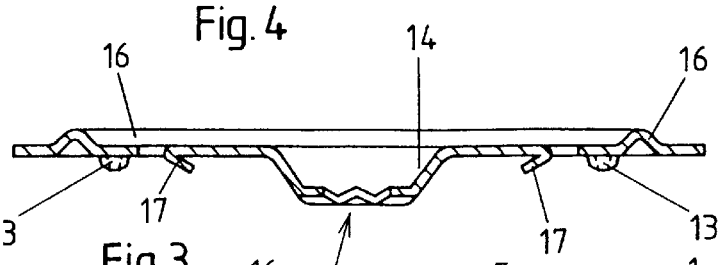
FIG. 4 shows a section along the line IV—IV in FIG. 3.
Figure 3:
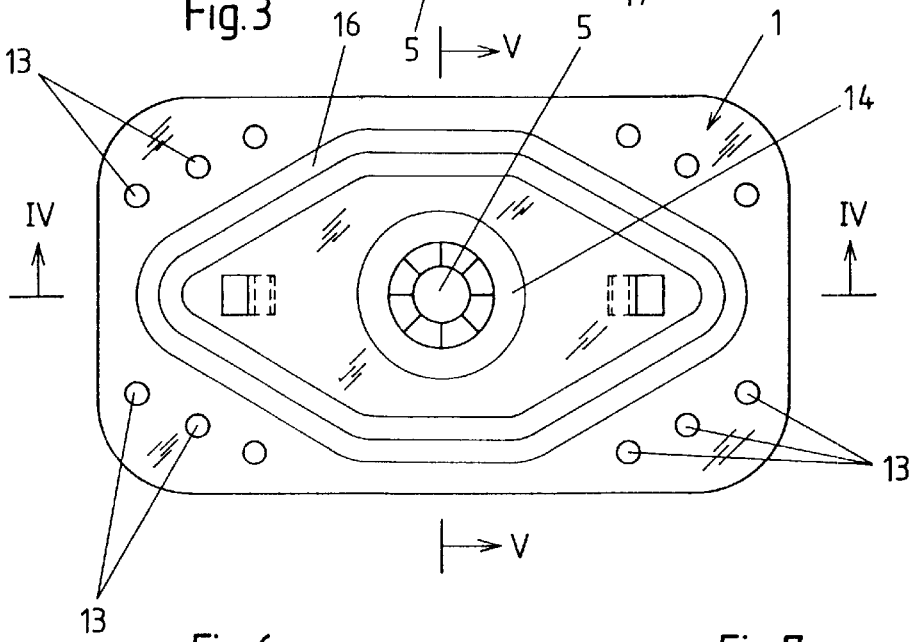
FIG. 3 shows a plan view of a washer from above.
Figure 5:
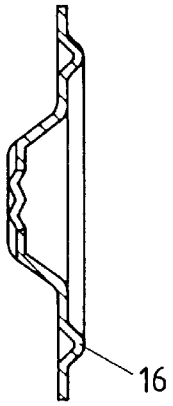
FIG. 5 shows a section along the line V—V in FIG. 3.

If now, as can be inferred from FIG. 2, the roofing sheets 3, 3', are pulled up by suction forces acting in the direction of arrow 10, then corresponding forces act on the screwed connection and particularly on the washer 1. The region of the washer 1, on the right hand side in the Figure, is pulled upward in the direction of arrow 11, whereas, the region of the washer 1 in the left hand side of the drawing is pushed downward, in the direction of arrow 12. This edge region of the roofing sheet 3 is now to be held securely under the washer 1 in the case of such an extreme attack of forces. For this purpose, a special arrangement and construction of the meshing elements 13, provided at the underside of the washer 1, is required and will be explained in greater detail below by means of FIGS. 3 to 8. In the embodiment shown in FIG. 3 in plan view, the washer 1 is constructed as a elongated rectangle. Of course, square washers or washers with a different exterior shape, such as that of an ellipse can also be used in the same way. The central opening 5, for inserting the fastener 6 is constructed in a depression 14 of the washer 1; the head 15 of the fastener 6 can be disposed in countersunk fashion due to this depression 14. A peripheral bead 16, serves to stiffen the washer so that a corresponding contacting pressure can be exerted over a large surface. The course or the arrangement of such a bead 16, or several such beads, can be accomplished in various ways, which have no significant relationship with the meshing elements 13. FIGS. 3 and 4 show downwardly bent brackets 17, the purpose of which is to hold washers, which are stacked on top of one another at an appropriate distance, so that the stacked washers can be singled in a simple manner.

What matters in the case of such large-area washers is how the friction of mutually contacting surfaces of the washer and of the panel and/or sheet to be fastened can be increased and how a meshing with a panel and/or sheet to be fastened can be improved. In the case of the washer described here, special meshing elements 13 are provided. These meshing elements 13 are pressed out from the full material of the washer 1, so that pointed, meshing elements 13, aligned at least approximately to the plane of washer 1, are formed. The most important measure lies therein that the meshing elements 13 are constructed, at least over a portion of their length, as peripherally closed conical, truncated conical, pyramidal, truncated pyramidal, or prismatic bodies. In other words, an essentially triangular bracket is not just simply bent downward to form the meshing element, as was customary up to now; instead, an meshing element 13 is created, which has a construction and action similar to that of a fully cast or injection-molded conical point.

Figure 9:
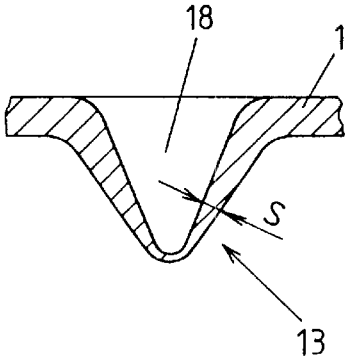

As may be inferred, for example, from FIG. 9, the meshing elements 13, are constructed from cup-like depressions 18, which have been pressed through from the full material of the washer 1. In such a stamping process, appropriate counter-tools are available for being able to achieve such an outwardly closed form after a deep drawing process.

In most cases, it makes sense if the meshing elements 13 have at their free end a relatively small axial opening 19, which is constructed particularly small in relation to the diameter at the foot of meshing elements 13. Especially when the meshing elements 13 are produced by deep drawing process, it is advantageous to provide appropriate angles matched to a particular effect of the meshing elements 13 in relation to the roofing sheet that is to be held. By these means, it is also achieved that the wall thickness S of the meshing element decreases steadily from the foot to the freely protruding end and that the freely protruding ends of the meshing elements 13 are somewhat more yielding than the regions immediately at the foot of the meshing elements 13. For example, the inner conical angle W1 is approximately 40° for the two embodiments of FIGS. 7 and 8. The outer conical angle W2 is approximately 70° for the embodiment of FIG. 7 and approximately 75° for the embodiment of FIG. 8. Advisably, the inner conical angle W1 is of the order of 30° to 50° preferably 35° to 45° and the outer conical angle W2 is of the order of 50° to 90° and preferably of 65° to 80°.

Figure 6:
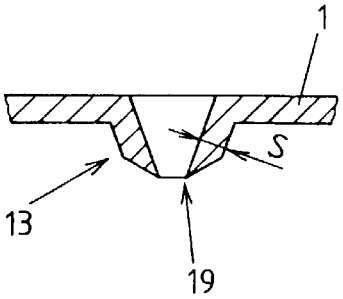
FIGS. 6 to 9 show different embodiments of meshing elements in the representation of section A in FIG. 4 on an enlarged scale.
Figure 7:
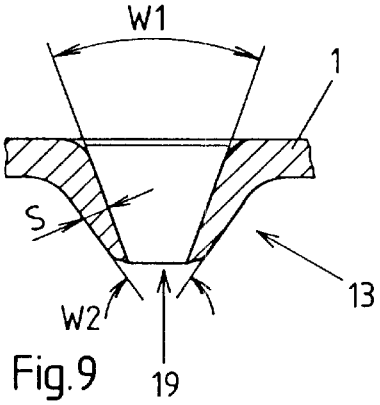
Figure 8:
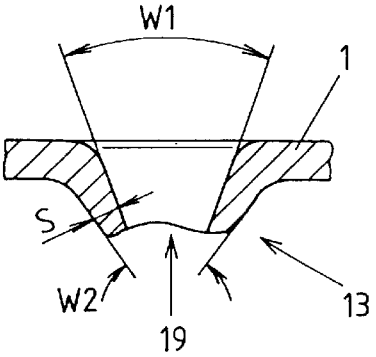

For the construction of FIG. 6, the wall thickness S is practically constant over the whole length, with the exception of the direct free end of the meshing element 13. The production of such a variation by a stamping process is also conceivable, in which case, the free end region of the meshing elements 13 so formed burst open slightly, so that a roughening or corresponding cracks, which increase the friction, are formed or form at the free end of the meshing elements 13. In the case of the embodiment of FIG. 8, it can be seen that a wave-shaped or toothed limiting edge, which in turn ensures a special friction-increasing effect when used in the roofing sheet, is formed at the free end of the meshing element.

From the geometry alone, it can be seen that the construction of such quite special meshing elements 13 can be used not only for large-area washers made from metal, but also for washers produced from plastic by injection molding.

In the case of the embodiments shown in FIGS. 6 to 9, the meshing elements 13 are peripherally closed practically over their whole length. It would also be conceivable to construct only the foot region of the meshing elements peripherally closed, the remaining region up to the free end being divided up intentionally or due to the requirements of the material into individual brackets, which continue to form a peripherally closed total form, with the exception of the narrow slots lying in between. It would also be conceivable to provide slots or tears in the foot region of the meshing elements, that is, in the transition region from the planar section of the washer to the slots or cracks corresponding to the meshing element, which then contribute practically at the outer wall of the meshing elements 13 to an increase in friction relative to the sheet to be fastened. Even though corresponding cracks or slots would then be present, no cutting edge-like constructions would result at the meshing elements 13.

In order to make good penetration of the meshing elements into the panel and/or sheet to be fastened possible, meshing elements 13 advantageously are constructed, which consist of a circumferentially closed conical, truncated conical, pyramidal, or truncated pyramidal body. It is, however, also possible to construct the meshing elements in the form of a cylindrical or prismatic body, in which case, however, the penetration behavior into the panel and/or sheet to be fastened would be inferior. However, especially due to the special construction at the free end of such a meshing element, there can be a significant increase in friction, which, in turn, makes possible a particularly effective large-area washer.

What is claimed is:

1. A large-area washer for attaching roofing sheets and/or insulation and having an opening for inserting a fastener, comprises:

protruding meshing elements pointing in a fastening direction, said meshing elements being used to increase at least one of friction and meshing with a panel and/or sheet to be fastened, several said meshing elements extending from a generally planar surface of the washer and oriented at least approximately perpendicularly to the planar surface of the washer, said meshing elements each having a foot generally at said planar surface and a free end, a hole extending within said meshing element from said foot and through said free end, wherein a wall thickness of said meshing elements decreases from said foot to said free end and an outer conical angle (W2) of said meshing elements is in a range of approximately 50° to 90° and an inner conical angle (W1) is in a range of approximately 30° to 50°.

2. A washer as in claim 1, wherein said hole in each said meshing element is small at said free end relative to a hole dimension at said foot.

3. A washer as in claim 1, wherein the outer conical angle of said meshing elements is in a range of approximately 65° to 80°.

4. A washer as in claim 1, wherein the inner conical angle of said meshing elements is in a range of approximately 35° to 45°.

5. A washer as in claim 1, wherein said hole has a generally closed circumference at said free end.

6. A washer as in claim 1, wherein said hole at said foot has a generally closed circumference.

* * * * *